US007177439B2

(12) United States Patent
Tardo et al.

(10) Patent No.: US 7,177,439 B2
(45) Date of Patent: Feb. 13, 2007

(54) METHODS AND APPARATUS FOR DISSIPATING HEAT IN A VOICE COIL

(75) Inventors: Timothy Bryan Tardo, Collinsville, MS (US); Hartley D. Peavey, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 209 days.

(21) Appl. No.: 10/382,705

(22) Filed: Mar. 6, 2003

(65) Prior Publication Data

US 2004/0175015 A1 Sep. 9, 2004

(51) Int. Cl.
*H04R 25/00* (2006.01)

(52) U.S. Cl. ..... 381/397; 381/407

(58) Field of Classification Search ..... 381/396–398, 381/400–407, 412, 420, 433
See application file for complete search history.

(56) References Cited

U.S. PATENT DOCUMENTS

| | | | | |
|---|---|---|---|---|
| 2,295,483 | A | 9/1942 | Knowles | |
| 2,858,377 | A * | 10/1958 | Levy | 381/341 |
| 4,313,040 | A * | 1/1982 | Tsukamoto | 381/425 |
| 4,378,471 | A * | 3/1983 | Shintaku | 381/420 |
| 4,387,275 | A * | 6/1983 | Shimada et al. | 381/162 |
| 5,062,140 | A * | 10/1991 | Inanaga et al. | 381/399 |
| 5,357,586 | A * | 10/1994 | Nordschow et al. | 381/397 |
| 5,450,499 | A * | 9/1995 | Morris et al. | 381/397 |
| 5,940,522 | A * | 8/1999 | Cahill et al. | 381/397 |
| 6,229,902 | B1 * | 5/2001 | Proni | 381/400 |
| 6,243,479 | B1 * | 6/2001 | Proni | 381/420 |
| 6,330,340 | B1 | 12/2001 | Proni | |
| 6,590,990 | B2 * | 7/2003 | Abe et al. | 381/407 |
| 2001/0031063 | A1 | 10/2001 | Langford et al. | |
| 2004/0052397 | A1 * | 3/2004 | Aronson et al. | 381/397 |

FOREIGN PATENT DOCUMENTS

EP 1 202 606 A2 5/2002

OTHER PUBLICATIONS

European Search Report, Feb. 21, 2006.

* cited by examiner

*Primary Examiner*—Suhan Ni
*Assistant Examiner*—Phylesha Dabney
(74) *Attorney, Agent, or Firm*—Kaplan Gilman Gibson & Dernier LLP

(57) ABSTRACT

The present invention is directed to methods and apparatus for dissipating heat in a voice coil of a loudspeaker, where at least one of: a bobbin having a substantially cylindrical shaped wall member is operable to support the voice coil, and the wall member includes at least one aperture operable to provide thermal communication from the voice coil through the wall member; and a heatsink is coupled to an outer surface of a bobbin and is in thermal communication with the voice coil.

39 Claims, 8 Drawing Sheets

METHODS AND APPARATUS FOR DISSIPATING HEAT IN A VOICE COIL

BACKGROUND OF THE INVENTION

The present invention is directed to methods and apparatus for dissipating heat in a voice coil of a loudspeaker, which improves heat transfer from the voice coil to a heatsink.

Loudspeakers (commonly called "speakers") are designed for the reproduction of audio signals having a frequency range of approximately 20 Hz to 20 kHz and a pressure range of approximately $10^{-5}$ to 50 pascals, or $10^{-9}$ to $7\times10^{-3}$ lbf/in.$^2$.

A loudspeaker system normally includes one or more drivers (a transducer mechanism without a structural radiation enclosure), a crossover network (ensuring that a received electrical drive signal is within an optimum frequency range), and an enclosure. Loudspeakers are used in many different consumer products, such as home and automobile stereos, television and radio receivers, electronic musical instruments, toys, etc. Loudspeakers are also used in any number of professional applications, such as in broadcast stations, recording studios, concert halls, etc.

Loudspeakers may be classified in accordance with several factors, including type of radiation, type of driving element, reproduction range, and diaphragm shape. The type of radiation may include direct radiation and horn-loaded radiation. The driving element may be a magnetic element, an electrostatic element, a piezoelectric element, an ionophone element, or an air-jet element. Magnetic driving elements include dynamic (moving-coil, ribbon, etc.), moving-armature, and magnetostrictive technologies. Reproduction ranges include low frequency (woofer and subwoofer) ranges, mid-frequency (midrange and squawker) ranges, high-frequency (tweeter and super-tweeter) ranges, and full-ranges. Diaphragm shapes include cone (e.g., straight, parabolic, flared, etc.), dome, and flat shapes.

A commonly used loudspeaker classification is the dynamic (moving-coil) direct-radiator loudspeaker. In this type of loudspeaker, a permanent magnet produces a high flux density in a narrow air gap in which a moving voice coil is located. The interaction of the flux of the permanent magnet and an alternating current flowing within the voice coil produces a force that moves a diaphragm to achieve a piston action. The movement of the diaphragm causes corresponding acoustic sound waves, which are preferably linearly related to the electrical driving signal in order to produce high fidelity sound. Further details concerning conventional loudspeaker technology may be found in McGraw-Hill, Encyclopedia of Electronics and Computers, pp. 512–518 ($2^{nd}$ ed., 1988).

A significant disadvantage associated with the dynamic (moving-coil) direct-radiator loudspeaker is that it has a relatively low radiation efficiency, i.e., a ratio of sound output power to electrical input power. Indeed, the radiation efficiency of this type of loudspeaker is on the order of 0.5 to 4 percent. This inefficiency generally results in a majority of the electrical input power being converted into heat.

The voice coil of the loudspeaker is the primary heat generating element. Conventional voice coil assemblies include a helical coil of electrical/magnet wire supported by a bobbin. The helical coil may be formed of a single layer or multiple layers of wire. The electrical/magnet wire may take on various shapes, such as IE, round, flat, etc. The bobbin typically consists of a single layer or multiple layers of sheet-like materials, for example, polyimide, aluminum, aromatic fiber, etc. The bobbin is shaped into a desired geometry around which the voice coil is wound. The bobbin supports the voice coil by way of adhesion between the voice coil and the bobbin. Such adhesion may be made to the inside, middle, outside, or a combination inside/outside of the voice coil. As the bobbin is typically used to provide a mechanical connection between the voice coil and the diaphragm (or speaker cone), a relatively high stiffness is desirable. In some instances, multiple layers of material are employed to increase the stiffness of the bobbin. Such layers may be placed in any number of locations along the bobbin to achieve such stiffness.

It is desirable that the bobbin exhibit stable thermal characteristics, particularly because the voice coil produces a significant amount of heat and operates at elevated temperatures. Conventional high-power loudspeakers may employ high-temperature materials in forming the bobbin such that it remains relatively stiff at elevated temperatures. Such materials include high glass transition point materials, i.e., TG and the like. Unfortunately, these high-temperature materials exhibit extremely poor thermal conductivity, which results in a thermal insulation layer between the voice coil and any fluids and/or structures proximate to the bobbin. For example, air, ferrofluids, etc. may occupy volumes within and/or around the bobbin; however, owing to the thermal insulation characteristics of the high-temperature materials utilized to produce the bobbin, relatively poor thermal conductivity is exhibited between the voice coil and such fluids. This disadvantageously increases thermal time constants between the voice coil and any nearby heat wicks (and/or other heatsink structures), and results in the elevation of voice coil temperatures.

Attempts at solving the above-described thermal management issue have been made, including forced air flow, metallic bobbin materials, impregnated bobbin materials, and inside/outside coil assemblies (e.g., a bobbin disposed between two voice coils). Each of these attempts were unsatisfactory. Forced air flow techniques require through-holes in the assembly or increasing the area around the voice coil to permit such air flow. These techniques, however, reduce the magnetic field and degrades performance. Although metallic bobbins exhibit good thermal conductivity, they cause back electro-motive force (BEMF), which further reduces the efficiency of the loudspeaker. Impregnated bobbin materials exhibit only marginal improvements in thermal conductivity, while exhibiting poor bonding strength and in some cases, BEMF. In inside/outside voice coil assemblies, the heat buildup between the voice coil and the bobbin (the bond line) is increased by a factor of two and the bond line exhibits poor thermal conductivity as compared with a single (inside or outside) design. This is so because the bond line is subjected to heat from both sides and any heat transfer out of one of the voice coils must traverse a heat source (the opposite voice coil) to reach ambient fluids.

Accordingly, there are needs in the art for new methods and apparatus for dissipating heat in a voice coil of a loudspeaker, which enjoy relatively high bobbin stiffness, bobbin thermal stability, and low thermal time constants between the voice coil and adjacent heat wicks.

SUMMARY OF THE INVENTION

A loudspeaker assembly in accordance with one or more aspects of the present invention includes: a voice coil; and a bobbin having a wall member operable to support the voice coil, the wall member including at least one aperture operable to provide thermal communication from the voice coil through the wall member. Preferably, the wall member is substantially cylindrical, although other shapes are also contemplated, such as oval, etc.

Preferably, the at least one aperture is shaped such that a reduction in a shear strength of the bobbin is substantially minimized. For example, the at least one aperture preferably has a shape that does not include sharp corners.

The total area defined by the respective sizes of the at least one aperture is preferably maximized.

Preferably, the voice coil includes an inner part defining an inner volume and an outer part; the loudspeaker further comprises a magnetic pole disposed at least partially within the inner volume of the voice coil and is operable to direct a magnetic flux therethrough; and the wall member of the bobbin includes an outer surface operable to support the voice coil and an inner surface defining an inner volume, the wall member including at least one aperture operable to provide thermal communication between the inner part of the voice coil and the magnetic pole.

The loudspeaker assembly preferably further includes a heatsink coupled to the magnetic pole and being operable to receive heat therefrom, wherein the aperture is sized, shaped, and located such that it is operable to provide thermal communication between the voice coil and the heatsink.

In accordance with one or more further aspects of the present invention, an apparatus includes a bobbin having a wall member (which is preferably cylindrical, oval, etc.) including an outer surface operable to support a voice coil of a loudspeaker and an inner surface defining an inner volume; and a heatsink coupled to the outer surface of the bobbin and being in thermal communication with the voice coil.

The heatsink preferably includes a plurality of fins extending radially away from the outer surface of the bobbin. The apparatus preferably further includes a diaphragm having an inner peripheral edge and an outer peripheral edge, the inner peripheral edge being operatively coupled to the outer surface of the bobbin, wherein the fins of the heatsink are operatively coupled to the diaphragm.

The diaphragm extends obliquely away from the outer surface of the bobbin to form a cone shape; and the fins of the heatsink each include a first edge extending along the outer surface of the bobbin and a second edge operatively coupled to the diaphragm thereby increasing a strength of the diaphragm.

The diaphragm includes a forward surface and a rearward surface, the forward surface defines an acute angle with respect to the outer surface of the bobbin; and the second edge of each fin defines a corresponding acute angle with respect to the first edge of the fin such that a substantial portion of the second edge of the fin is operable to couple to the forward surface of the diaphragm.

The apparatus preferably further includes a thermally conductive member being coupled to the outer surface of the bobbin and being in thermal communication with the voice coil and the heatsink. The thermally conductive member includes an inner surface and an outer surface; the inner surface of the thermally conductive member is coupled to the outer surface of the bobbin; and the inner wall of the heatsink is coupled to the outer surface of the thermally conductive member.

The voice coil defines an inner wall and an outer wall, the inner wall of the voice coil being coupled to the outer surface of the bobbin; and the inner surface of the thermally conductive member is in thermal communication with outer wall of the voice coil. Preferably, the voice coil defines an inner wall and an outer wall, the inner wall of the voice coil being coupled to the outer surface of the thermally conductive member.

In accordance with one or more further aspects of the invention, the speaker assembly may further include a heatsink coupled to the inner surface of the wall member of the bobbin such that it is in thermal communication with the voice coil. The heatsink includes a plurality of fins extending axially along and radially inward from the inner surface of the bobbin such that axial movement of the bobbin forces air within the inner volume of the bobbin to carry heat away from the second heatsink.

In accordance with one or more further aspects of the invention, the speaker assembly may further include: a pole disposed at least partially within the inner volume of the voice coil that is operable to direct a magnetic flux therethrough, the pole including an aperture extending therethrough that is in axial alignment with the bobbin and the voice coil; and a heatsink coupled to an inner surface of the aperture of the pole, wherein the heatsink includes a plurality of fins extending axially along and radially inward from the inner surface of the aperture such that axial movement of the bobbin forces air to carry heat away from the heatsink.

Other aspects, features, advantages, etc. will become apparent to one skilled in the art in view of the description herein taken in conjunction with the accompanying drawing.

BRIEF DESCRIPTION OF THE DRAWINGS

For the purposes of illustrating the invention, there are shown in the drawings forms that are presently preferred, it being understood, however, that the invention is not limited to the precise arrangements and instrumentalities shown.

DETAILED DESCRIPTION OF THE INVENTION

Figure 1:
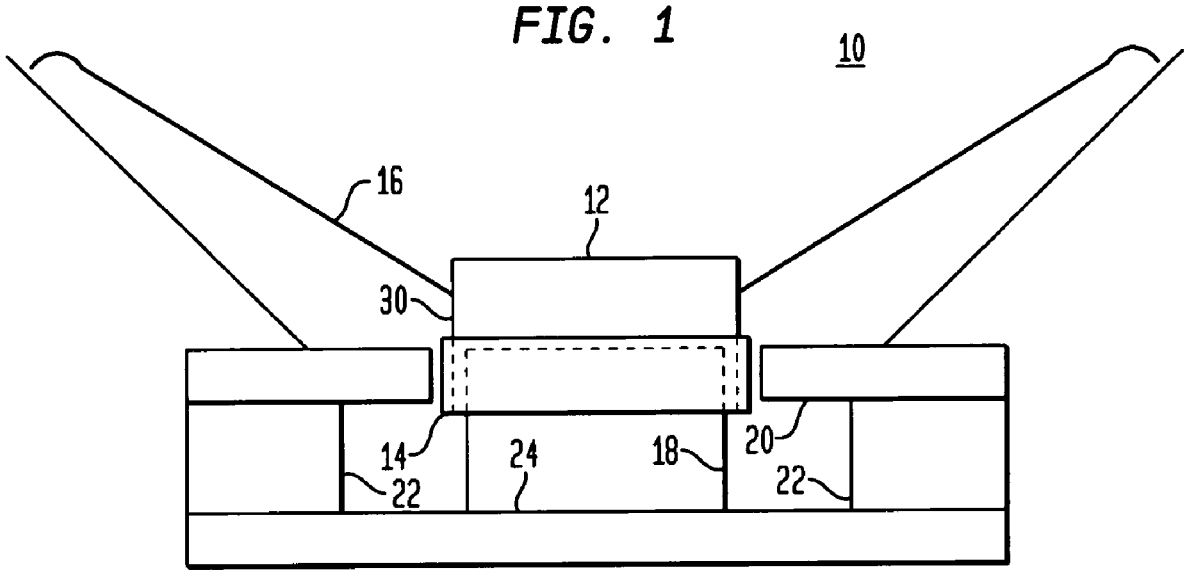
FIG. 1 is a side schematic view of a loudspeaker assembly employing one or more aspects of the present invention.

With reference to the drawings, wherein like numerals indicate like elements, there is shown in FIG. 1 a loudspeaker assembly 10 employing one or more aspects of the present invention. The loudspeaker assembly 10 includes a bobbin 12, a voice coil 14, a diaphragm (or cone) 16, and a magnetic structure including a magnetic pole 18, a top plate 20, a permanent magnet 22, and a back plate 24.

In general, the permanent magnet 22 induces a magnetic flux in the top plate 20, the back plate 24, and the magnetic pole 18 such that the magnetic flux is directed through the voice coil 14. An electrical drive signal is applied to the voice coil 14 in order to induce an alternating current in the voice coil 14, which creates a proportional electromagnetic flux. The electromagnetic flux of the voice coil 14 interacts with the magnetic flux produced by the permanent magnet 22, thereby creating a force on the voice coil 14 in the upward/downward direction. The force tends to move the voice coil 14 and the bobbin 12 because the voice coil 14 is mechanically coupled to the bobbin 12. As an inner peripheral edge 30 of the diaphragm 16 is mechanically coupled to the bobbin 12, the movement of the bobbin 12 in response to the electrical drive signal causes a corresponding movement of the diaphragm 16. The movement of the diaphragm 16 creates sound waves in proportion to the electronic drive signal.

The voice coil 14, which itself may be of conventional construction, may exhibit a real resistance of approximately 4, 8, or 16 Ohms. Other resistances are also contemplated. The current induced in the voice coil 14 by way of the electrical drive signal causes a temperature rise in the voice coil 14, which over time tends to reduce the useful life of the loudspeaker 10. This temperature rise also increases the resistance of the voice coil 14 and reduces the efficiency of the loudspeaker 10 (sometimes by 50%). So-called power compression may also occur. Power compression occurs when an operator increases the electrical drive signal (e.g., current) to the loudspeaker 10 in order to compensate for a lower acoustic output power resulting from the reduction in efficiency (caused by a temperature increase in the voice coil 14). The increased drive signal contributes to further increases in the temperature and resistance of the voice coil 14, and further reductions in efficiency and acoustic output power. This is an undesirable positive feedback scenario. In accordance with one or more aspects of the present invention, however, advantageous thermal management is employed, which tends to reduce the temperature elevation in the voice coil 14 resulting from the electrical drive signal.

Figure 2:
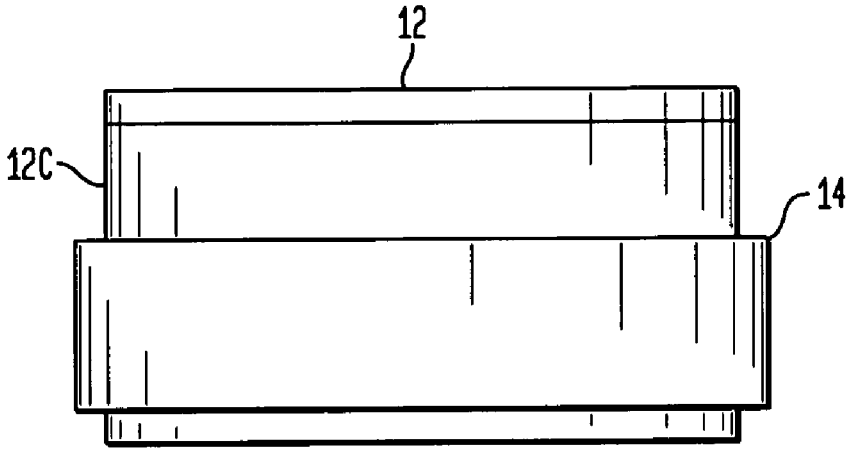
FIG. 2 is a side elevational view of a portion of the loudspeaker assembly of FIG. 1.
Figure 3:
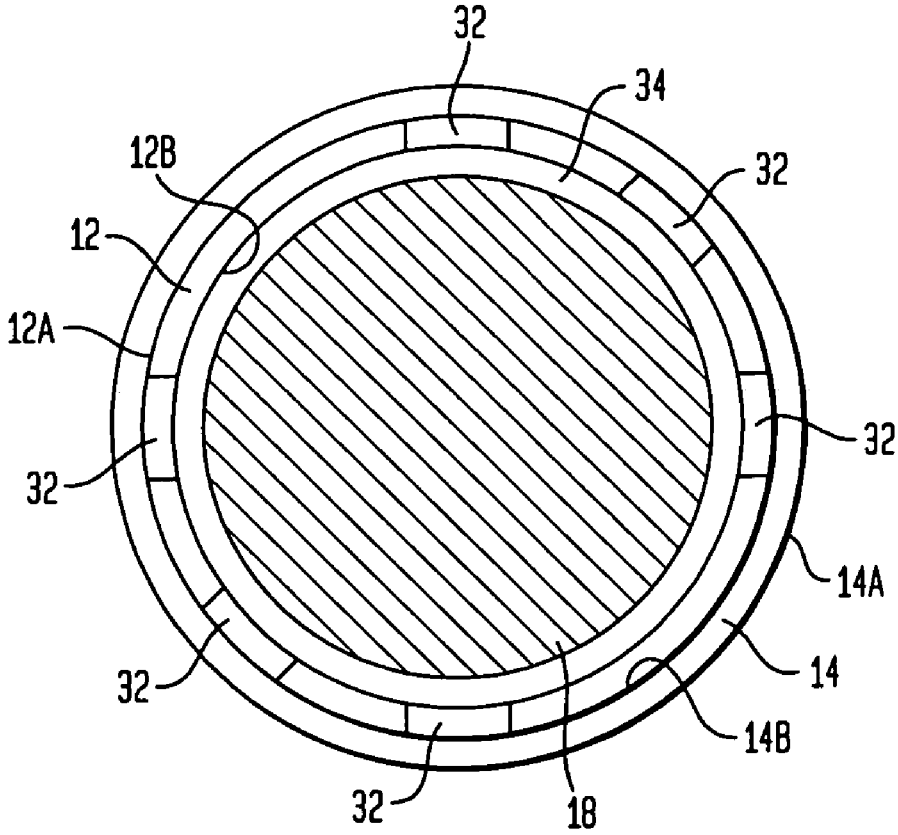
FIG. 3 is a top view of the apparatus of FIG. 2.

With reference to FIGS. 2 and 3, the bobbin 12 is preferably substantially cylindrical in shape and includes a wall member having an outer surface 12A and an inner surface 12B. It is noted that the bobbin 12 may take on other shapes such as oval, etc., without departing from the scope of the invention. The voice coil 14 preferably includes an outer part 14A (which may be thought of as an outer surface) and an inner part 14B (which may be thought of as an inner surface). The voice coil 14 is preferably supported by the bobbin 12. Although any of the conventional techniques may be employed to ensure that the bobbin 12 supports the voice coil 14, the illustrations in FIGS. 2 and 3 show that the outer surface 12A of the bobbin 12 supports the inner part 14B of the voice coil 14.

As shown in FIG. 2, the bobbin 12 may be constructed of a single layer or may include additional layers 12C to improve mechanical stiffness. By way of example, the bobbin 12 may be formed from a high temperature material, such as polyimide, aluminum, aromatic fiber, etc., with a high glass transition point, TG. The additional layer 12C may be formed from the same or similar materials.

The bobbin 12 (and any additional layers 12C) preferably include at least one aperture 32 through the wall member, which are operable to provide thermal communication between the inner part 14B of the voice coil 14 and an inner volume 34 defined by the inner surface 12B of the bobbin 12. Advantageously, the apertures 32 improve the thermal conductivity from the voice coil 14 to any structures and/or fluids within the volume 34, even in the presence of poor thermally conductive materials, such as a high temperature material layer 12 and 12C.

As best seen in FIGS. 1 and 3, at least a portion of the magnetic pole 18 extends into the volume 34 of the bobbin 12. Preferably, the apertures 32 are located through the wall member of the bobbin 12 such that they permit thermal communication between the voice coil 14 (such as the inner part 14B of the voice coil 14) and the magnetic pole 18. Advantageously, the magnetic pole 18 is a relatively dense structure that exhibits reasonable thermal conductivity and may be used to conduct heat away from the voice coil 14. In accordance with one or more aspects of the present invention, the apertures 32 advantageously improve the thermal communication between the voice coil 14 and the magnetic pole 18, thereby lowering the operating temperature of the voice coil 14.

It is noted that in the embodiment illustrated in FIGS. 2 and 3, the outer surface 12A of the bobbin 12 supports the voice coil 14. It is understood, however, that other configurations are contemplated by the invention. For example, the voice coil 14 may be disposed in the volume 34 such that the inner surface 12B of the bobbin 12 supports the voice coil 14. In this case, the apertures 32 are operable to provide thermal communication from the voice coil 14 through the wall member of the bobbin 12 to structures and/or fluids exterior to the bobbin 12.

Figure 4:
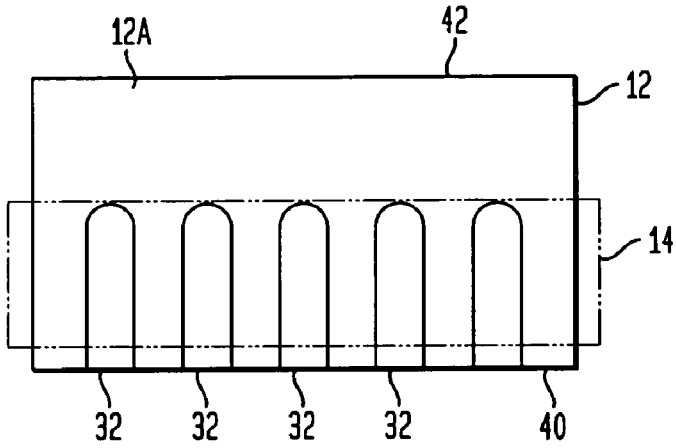
FIG. 4 is a side view of a bobbin portion of the apparatus of FIG. 2 employing one or more aspects of the present invention.
Figure 5:
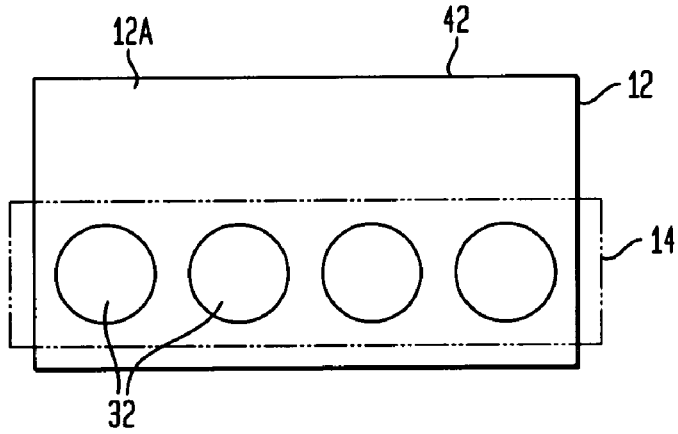
FIG. 5 is a side elevational view of a bobbin portion of the apparatus of FIG. 2 employing one or more further aspects of the present invention.
Figure 6:
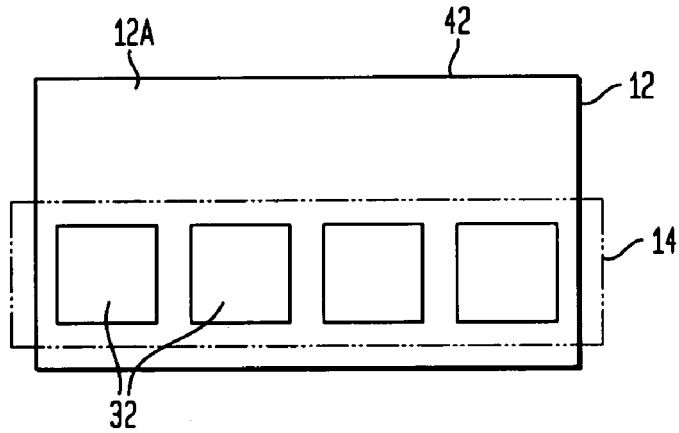
FIG. 6 is a side elevational view of a bobbin portion of the apparatus of FIG. 2 employing one or more still further aspects of the present invention.

Reference is now made to FIGS. 4–6, which are side elevational views of bobbins 12 employing various apertures 32 in accordance with one or more aspects of the present invention. The voice coil 14 is shown in phantom lines disposed about the outer surface 12A of the bobbin 12. Again, the voice coil 14 may be disposed about the inner surface 12B (which cannot be readily seen in FIGS. 4–6).

As it is desirable that the bobbin 12 exhibit substantial stiffness and strength, even at elevated temperatures, it is preferred that the apertures 32 are sized and/or shaped such that any reductions in strength, such as sheer strength, of the bobbin 12 is substantially minimized. In this regard, it is preferred that the apertures 32 have shapes that do not include substantially sharp corners. Indeed, sharp corners represent relatively high energy sites that may develop cracks and/or otherwise weaken the bobbin 12, particularly in the presence of relatively severe accelerations. Thus, the curved shapes of the apertures 32 in FIGS. 4 and 5 are desirable. Nevertheless, as illustrated in FIG. 6, square, rectangular, and/or other shapes that include sharp corners are not outside the scope of the invention as they will still exhibit advantageous thermal management properties.

Turning again to FIG. 4, the wall member of the bobbin 12 includes a first peripheral edge 40 and a second peripheral edge 42, spaced away from the first peripheral edge 40. The apertures 32 preferably have a substantial slot shape extending from one of the first peripheral edge 40 and/or the second peripheral edge 42 of the bobbin 12. The apertures 32 preferably include at least some portion that is disposed between the first and second edges 40, 42 of the bobbin 12 that corresponds to (and/or otherwise aligns with) the inner part 14B of the voice coil 14. Alternatively, when the voice coil 14 is disposed in the inner volume 34 of the bobbin 12, then the apertures 32 are preferably located such that a substantial portion thereof corresponds with the outer part 14A of the voice coil 14.

It is preferred that a total area defined by the respective sizes of the apertures 32 is maximized in order to maximize the thermal communication from the voice coil 14 through the apertures 32. While it is understood that the present invention is not limited by any theory of operation, it has been discovered that there is a combination of aperture size, shape, and/or location that can substantially minimize any reduction in strength of the bobbin 12 while substantially maximizing the sizes of the apertures 32 in order to achieve an advantageous balance between strength and thermal management goals.

Figure 7A:
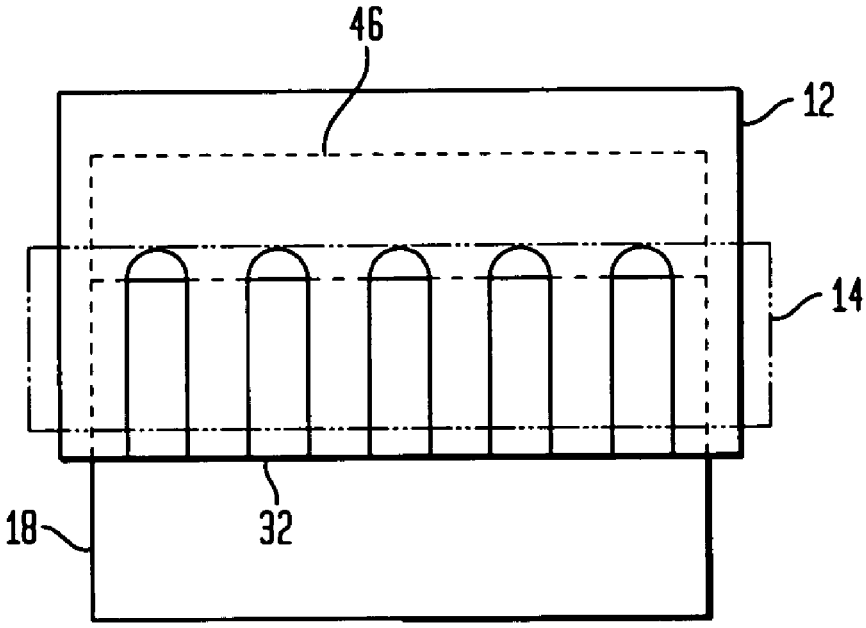
FIGS. 7A–B are side elevational views illustrating one or more further aspects of the present invention relating to heat transfer.
Figure 7B:
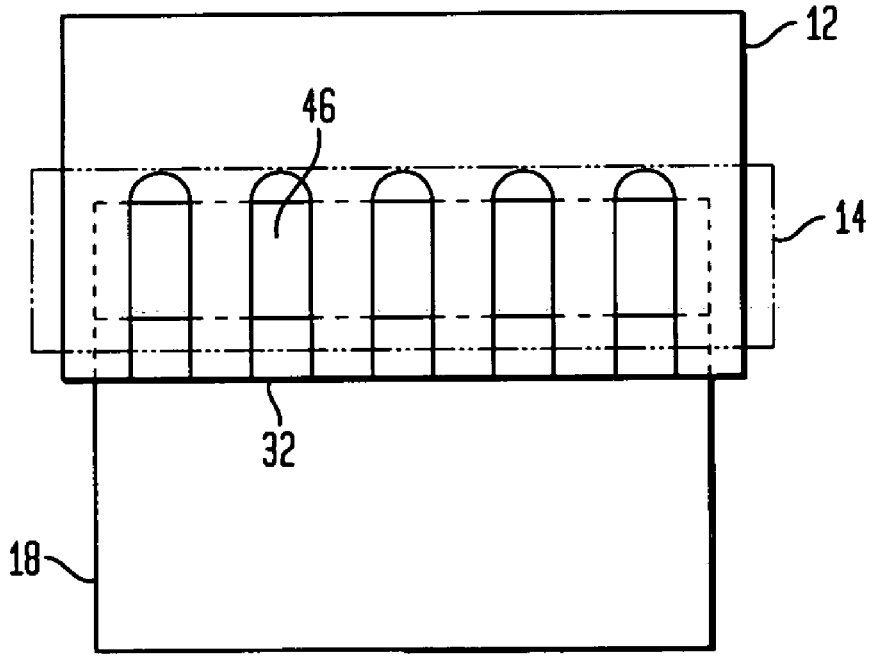

Reference is now made to FIGS. 7A–7B, which are side elevational views of the bobbin 12, voice coil 14, and the magnetic pole 18 in different stages of relative movement. In particular, the bobbin 12 and voice coil 14 travel in the upward/downward direction with respect to the magnetic pole 18 in response to the electrical drive signal. The loudspeaker 10 preferably further includes a heatsink 46 coupled to the magnetic pole 18 and being operable to receive heat from the magnetic pole 18 in order to reduce the temperature thereof. As shown, when the bobbin 12 and voice coil 14 are displaced downwardly with respect to the magnetic pole 18, a substantial portion of the respective apertures 32 are located adjacent to (and/or are in communication with) the magnetic pole 18. In contrast, when the bobbin 12 and voice coil 14 are displaced upwardly with respect to the magnetic pole 18 (FIG. 7B), then a lesser portion (and/or no portion) of each aperture 32 is located adjacent to the magnetic pole 18.

In accordance with one or more aspects of the present invention, the apertures 32 are preferably sized, shaped, and/or located on the bobbin 12 in such a way that they provide thermal communication between the voice coil 14 and the heatsink 46 during at least some displacements. In this way, some of the heat generated by the voice coil 14 is communicated to the magnetic pole 18 through the apertures 32, while some of the heat is communicated to the heatsink 46 through the apertures 32. While the present invention is not intended to be limited by any theory of operation, the respective amounts of heat communicated to the magnetic pole 18 and the heatsink 46 through the apertures 32 is proportional to the integral of the time that the apertures 32 are located adjacent to the magnetic pole 18 and the heatsink 46.

Advantageously, the apertures 32 through the wall member of the bobbin 12 provide thermal communication from the voice coil 14 through the bobbin 12 to structures and/or fluids that assist in reducing the temperatures at which the voice coil 14, bobbin 12, etc. operate. This advantageously improves the performance and useful life of the loudspeaker 10.

Figure 8:
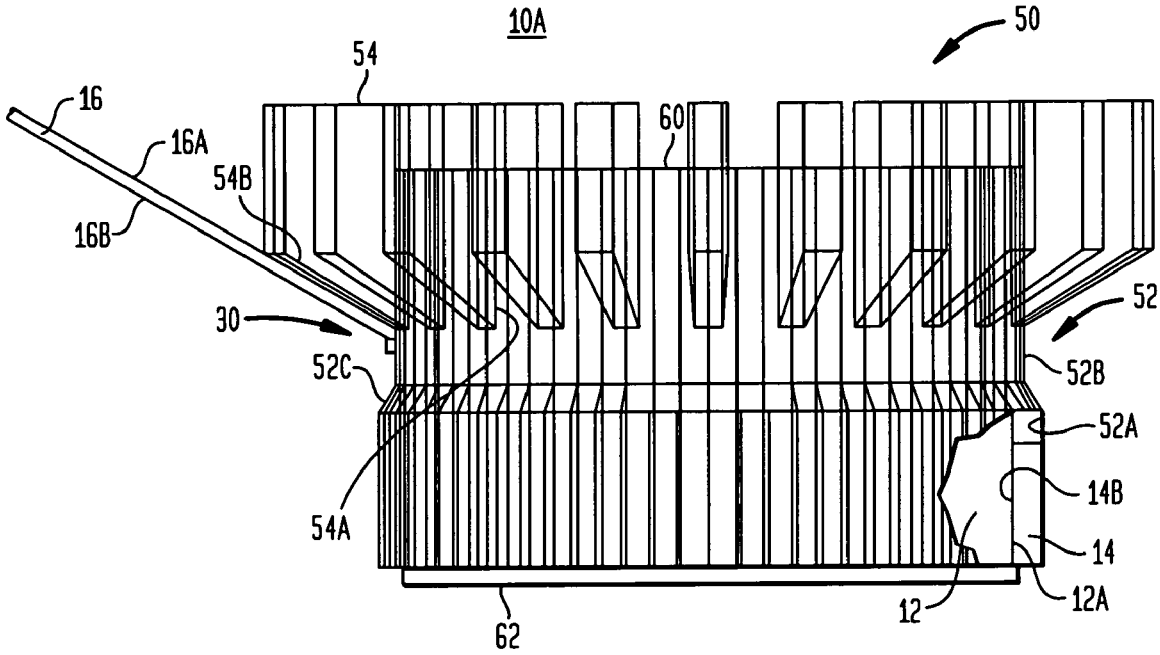
FIG. 8 is a side elevational view of a bobbin and heatsink assembly for a loudspeaker employing one or more further aspects of the present invention.

Reference is now made to FIG. 8, which is a side elevational view of a portion of a loudspeaker 10A in accordance with one or more further aspects of the present invention. The portion of the loudspeaker 10A shown in FIG. 8 includes a bobbin 12, a voice coil 14, a diaphragm 16 and a heatsink 50. It is noted that the bobbin 12 may include the apertures 32 discussed hereinabove with respect to FIGS. 1–7B; however, they need not be employed in accordance with the some aspects of the present invention. The heatsink 50 is preferably coupled to the outer surface 12A of the bobbin 12, either directly or by way of an intermediate material 52 (which will be discussed in more detail hereinbelow). The heatsink 50 preferably includes a plurality of fins 54 extending radially outward from the bobbin 12. More particularly, and with reference to FIG. 9, the heatsink 50 preferably exhibits a substantially cylindrical envelope defining an inner wall 56 and an outer wall 58. The outer wall 58 is shown in a dashed line because it is not a smooth surface, but rather is an envelope defined by the fins 54. The inner wall 56 is preferably operatively coupled to the outer surface 12A of the bobbin 12. The heatsink 50 is preferably in thermal communication with the voice coil 14.

The bobbin 12 includes a forward axial end 60 and a rearward axial end 62. The voice coil 14 may be disposed toward the rearward axial end 62, while the heatsink 50 may be disposed toward the forward axial end 60. As will be discussed in more detail below, this permits the heatsink 50 (in particular the fins 54 thereof) to be operatively coupled to the diaphragm 16. As it is desirable that the heatsink 50 be in thermal communication with the voice coil 14, it is preferred that a thermally conductive member 52 is coupled to the outer surface of the bobbin 12A such that it is in thermal communication with, and provides thermal communication between, the voice coil 14 and the heatsink 50. The thermally conductive member 52 preferably includes an inner surface 52A and an outer surface 52B. The inner surface 52A of the thermally conductive member 52 is preferably coupled to the outer surface 12A of the bobbin 12. The inner wall 56 of the heatsink 50 is preferably coupled to the outer surface 52B of the thermally conductive member 52. In this way, the heatsink 50 is advantageously in thermal communication with the voice coil 14. It is noted that the thermally conductive member 52 may be omitted when the bobbin 12 has sufficient thermal conductivity properties. It is also noted that the heatsink 50 and the thermally conductive member 52 may be integrally formed if desired.

As shown in FIG. 8, the inner part 14B of the voice coil 14 is coupled to the outer surface 12A of the bobbin 12, and the inner surface 52A of the thermally conductive member 52 is coupled to the outer part 14A of the voice coil 14. In this regard, the thermally conductive member 52 may include a bevel 52C in order to accommodate the increase in diameter from the outer surface 12A of the bobbin 12 to the outer part 14A of the voice coil 14. It is noted, however, that the voice coil 14 may be disposed about the thermally conductive member 52 such that the inner part 14B of the voice coil 14 is coupled to the outer surface 52B of the thermally conductive member 52B. In this regard, the bevel portion 52C of the heat thermally conductive member 52 need not be employed.

While any suitable material may be employed to form the thermally conductive member 52, such as copper, aluminum, etc., it is preferred that the materials are not metallic in order to avoid the creation of eddy currents (and BEMF), which oppose the desired movement of the bobbin 12/voice coil 14 assembly. For example, carbon pitch fiber may be utilized to form the thermally conductive member 52, which material exhibits satisfactory thermal conductivity without employing electrically conductive materials.

The inner peripheral edge 30 of the diaphragm 16 is preferably coupled to the outer surface 52B of the thermally conductive member 52, or to the outer surface 12A of the bobbin 12 (when a thermally conductive member 52 is not employed). The diaphragm 16 includes a forward surface 16A and a rearward surface 16B. The diaphragm 16 extends obliquely away from the outer surface 52B of the thermally conductive member 52 such that the forward surface 16A of the diaphragm 16 defines a cone. Stated another way, the forward surface 16 of the diaphragm 16 defines an acute angle with respect to the outer surface 52B of the thermally conductive member 52.

The heatsink 50 is preferably operatively coupled to the forward surface 16A of the diaphragm 16. In particular, the fins 54 are coupled to the diaphragm 16. Preferably, the fins 54 of the heatsink 50 each include a first edge 54A extending along the outer surface 52B of the thermally conductive member 52 (or the outer surface 12A of the bobbin 12). These fins 54 also preferably include a second edge 54B operatively coupled to the forward surface 16A of the diaphragm 16. Advantageously, the increased area of mechanical coupling between the diaphragm 16 and the thermally conductive member 52/bobbin 12 increases the strength of the diaphragm 16, thereby improving its useful life.

Figure 9:
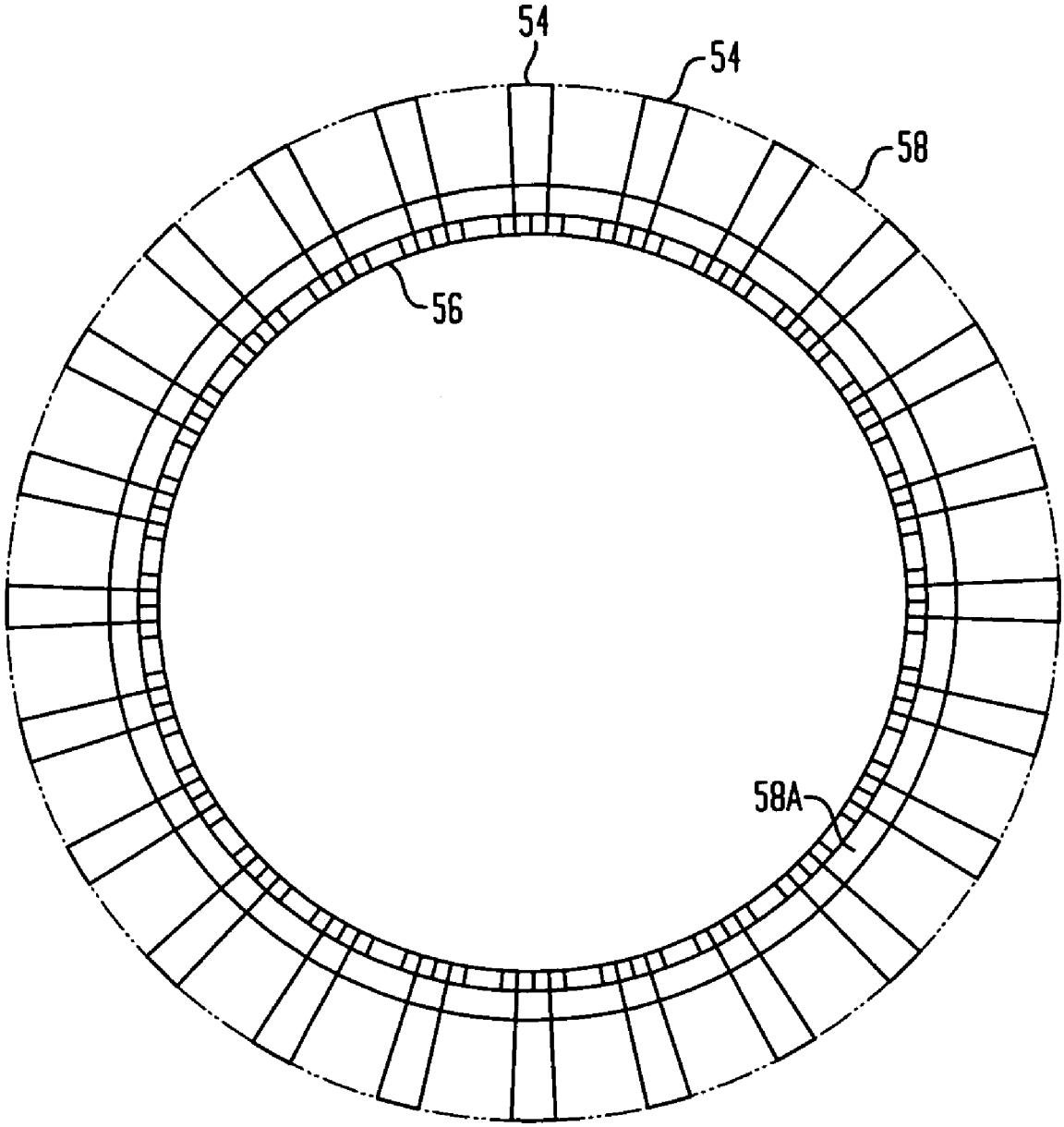
FIG. 9 is a top view of the heatsink of FIG. 8.

Viewing the heatsink 50 as an overall envelope (FIG. 9), the outer wall 58 of the heatsink 50 includes a beveled portion 58A that is operatively coupled to the forward surface 16A of the diaphragm 16. It is noted that the beveled portion 58A is not a smooth surface, but rather an envelope defined by the second edges 54B (FIG. 8) of the heatsink 50. As the mass of the heatsink 50 increases the overall inertia of the combined bobbin 12, voice coil 14, thermally conductive member 52, diaphragm 16, etc., it is desirable to substantially minimize the mass. Any number of techniques may be employed to reduce the mass of the heatsink 50, such as the selection of relatively light materials, such as aluminum. Additional techniques may be employed to reduce the mass of the heatsink 50, including utilizing hollow fins 54. Alternatively, as best seen in FIG. 9, the heatsink 50, and the fins 54 in particular, may be formed by way of a corrugated design for example, where the fins 54 are spaced apart by an amount about equal to their width (e.g., about ⅛"). Preferably, the heatsink 50 is formed from "fin stock," which resembles the construction of the fins of an automobile radiator.

Advantageously, the heatsink 50 provides an additional way in which the heat from the voice coil 14 may be dissipated. In addition, the structure of the heatsink 50, vis-à-vis its mechanical coupling to the diaphragm 16, increases the strength of the diaphragm 16 and improves the operation and useful life of the loudspeaker 10A.

Figure 10:
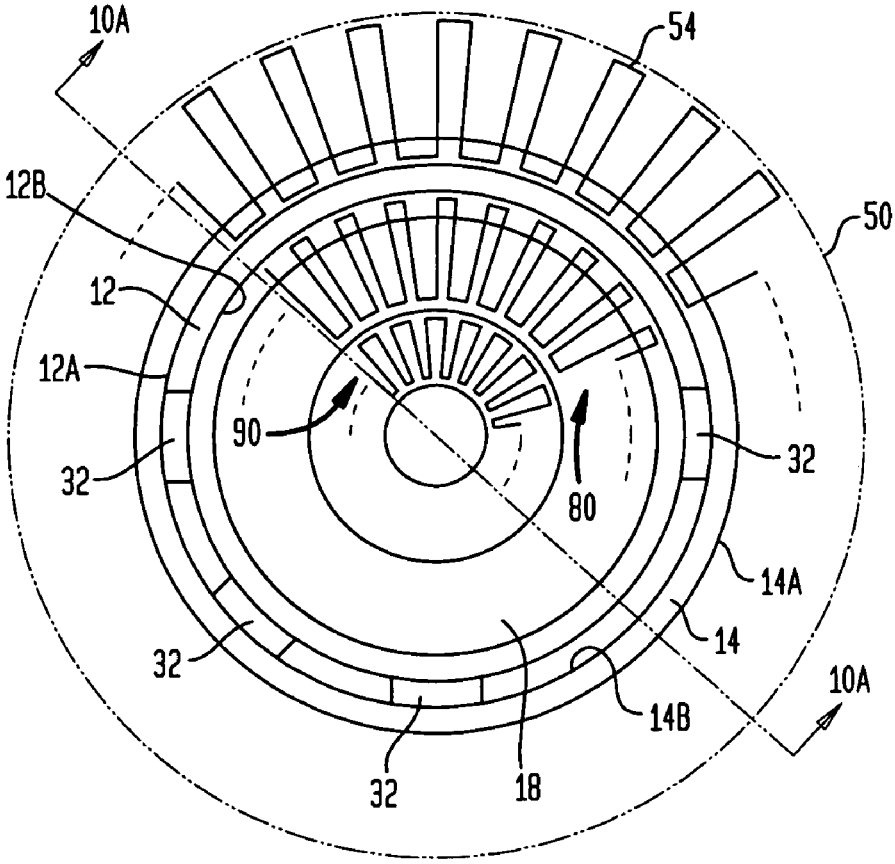
FIG. 10 is a top view of a portion of a speaker apparatus in accordance with the invention that includes one or more heatsinks disposed on the outside of a bobbin, the inside of the bobbin, and/or the inside of a pole piece.
Figure 10A:
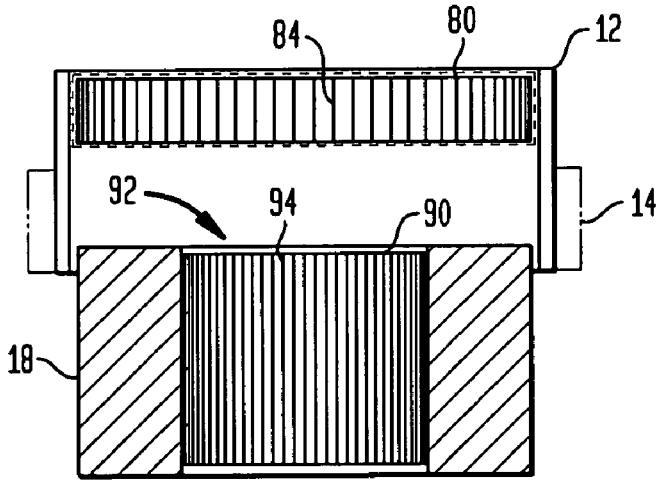
FIG. 10A is a side sectional view of FIG. 10 taken through 10A—10A.

Reference is now made to FIG. 10, which is a top view of a portion of a speaker assembly in accordance with the present invention. This portion of the speaker assembly is substantially similar to the assemblies illustrated in FIGS. 2 and 3 hereinabove, where the heatsink 50 (and the fins 54) of FIG. 8 are also illustrated. In accordance with one or more further aspects of the present invention, the assembly further includes a heatsink 80 coupled to the inner surface 12B of the substantially cylindrical shaped wall member of the bobbin 12. Preferably, the heatsink 80 includes a plurality of fins 84 extending axially along and radially inward from the inner surface 12B of the bobbin 12. The heatsink 80 may be formed in ways substantially similar to the heatsink 50, such as by way of fin stock. The heatsink 80 is preferably in thermal communication with the voice coil 14, either by way of the bobbin 12, the apertures 32, and/or a thermally conductive member (not shown). Preferably, axial movement of the bobbin 12 forces air within the inner volume 34 of the bobbin 12 to carry heat away from the heatsink 80. With reference to FIG. 10A, the heatsink 80 is preferably disposed axially forward of the voice coil 14 and the pole 18 such that electrical interference with the voice coil 14 and physical interference with the pole 18 is avoided when the bobbin 12 moves.

Advantageously, the heatsink 80 provides further means by which heat from the voice coil 14 may be dissipated. In addition, the structure of the heatsink 80, vis-à-vis its mechanical coupling to the bobbin 12, increases the strength of the bobbin 12 and improves the operation and useful life of the loudspeaker 10.

In accordance with one or more further aspects of the present invention, the pole 18 includes an aperture 92 extending therethrough that is in axial alignment with the bobbin 12 and the voice coil 14. Preferably, the back plate 24 (FIG. 1) includes an aperture (not shown) that aligns with the aperture 92 of the pole 18. Preferably, a heatsink 90 is coupled to an inner surface created by the aperture 92 of the pole 18. The heatsink 90 preferably includes a plurality of fins 94 extending axially along and radially inward from the inner surface created by the aperture 92 such that axial movement of the bobbin 12 forces air to carry heat away from the heatsink 90. The heatsink 90 may be formed in ways substantially similar to the heatsink 50, such as by way of fin stock. Advantageously, the heatsink 90 provides yet an additional way in which the heat from the voice coil 14 may be dissipated.

Figure 11:
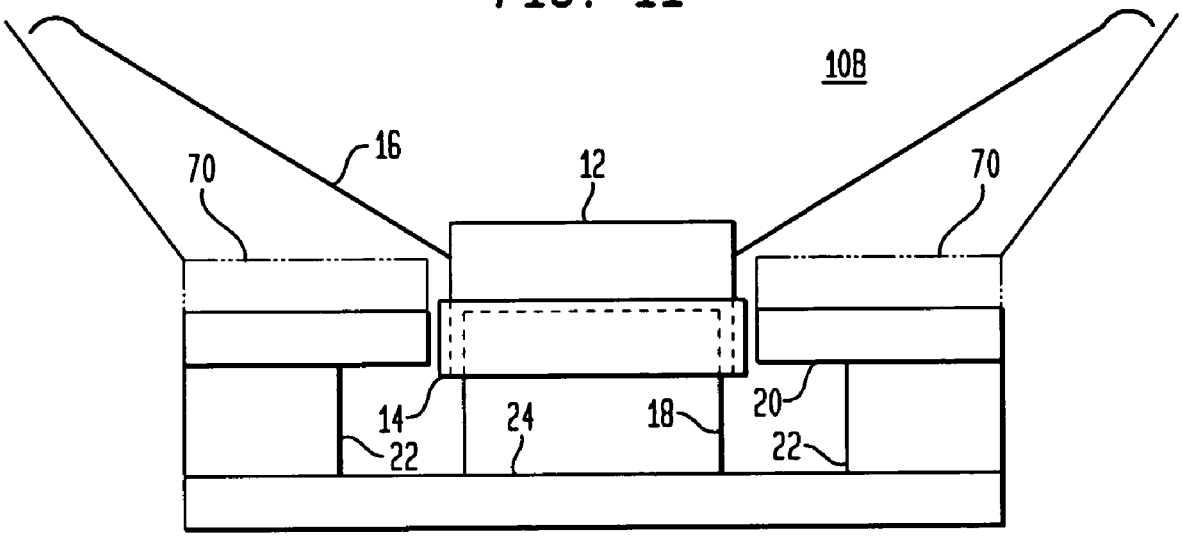
FIG. 11 is a side schematic view of a loudspeaker assembly employing one or more further aspects of the present invention, such as a heatsink ring disposed above a top plate.
Figure 12:
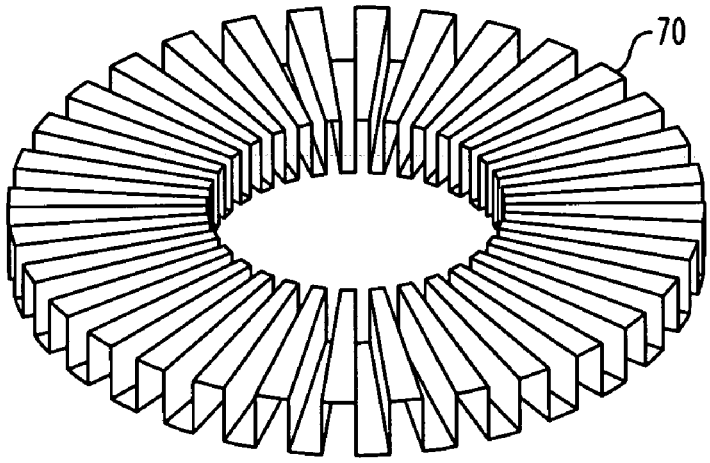
FIG. 12 is a perspective view of the heatsink ring of FIG. 11.

Reference is now to FIGS. 11 and 12, which illustrate a speaker assembly 10B in accordance with one or more further aspects of the present invention. In many ways, the speaker assembly 10B is substantially similar to that discussed hereinabove with respect to FIG. 1 and may include some or all of the same features. More particularly, however, the speaker assembly 10B includes a heatsink 70 disposed on the top plate 20. The top plate 20 has a general disk shape, an upper surface and an aperture therethrough. The aperture is in coaxial alignment with the voice coil 14 and an upper portion of the pole 18. As best seen in FIG. 12, the heatsink 70 also has a general disk shape. The heatsink 70 also includes a lower surface, and an aperture. The lower surface of the heatsink 70 is coupled (such as by thermal bonding) to the upper surface of the top plate 20 such that the aperture of the heatsink 70 is axially aligned with the aperture of the top plate 20. As best seen in FIG. 12, the heatsink 70 includes a plurality of fins extending radially outward from the aperture such that they are in thermal communication with the voice coil 14, and such that axial movement of the bobbin 12 forces air to carry heat away from the heatsink 70. Advantageously, the heatsink 70 provides a further way in which the heat from the voice coil 14 may be dissipated.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A loudspeaker assembly, comprising:

a voice coil;

a magnetic pole in electro-magnetic communication with the voice coil;

a bobbin having a wall member including at least one aperture therethrough, the voice coil being supported by the wall member and overlying all of the at least one aperture to: (i) provide thermal communication from the voice coil through the wall member to the magnetic pole; and (ii) inhibit air flow through the at least one aperture.

2. The loudspeaker assembly of claim 1, wherein at least one of:

the at least one aperture is shaped such that a reduction in a shear strength of the bobbin is substantially minimized;

a total area defined by the respective sizes of the at least one aperture is maximized; and the at least one aperture has a shape that does not include sharp corners.

3. The loudspeaker assembly of claim 1, wherein at least one of:

the wall member includes a first peripheral edge and a second peripheral edge spaced away from the first peripheral edge;

the at least one aperture includes at least some portion between the first and second peripheral edges; and the at least one aperture includes at least some portion terminating at at least one of the first and second peripheral edges.

4. The loudspeaker assembly of claim 3, wherein the at least one aperture has a substantial slot shape extending from one of the first and second peripheral edges toward the other of the first and second peripheral edges and terminating in a rounded edge.

5. The loudspeaker assembly of claim 3, wherein the portion of the aperture between the first and second peripheral edges is preferably disposed at a location that corresponds to an inner part of the voice coil.

6. The loudspeaker assembly of claim 1, wherein at least one of:

the voice coil includes an inner part defining an inner volume and an outer part;

the loudspeaker further comprises a magnetic pole disposed at least partially within the inner volume of the voice coil and is operable to direct a magnetic flux therethrough; and the wall member of the bobbin includes an outer surface operable to support the voice coil and an inner surface defining an inner volume, the at least one aperture being operable to provide thermal communication between the inner part of the voice coil and the magnetic pole.

7. The apparatus of claim 6, further comprising a heatsink coupled to the magnetic pole and operable to receive heat therefrom, wherein the aperture is sized, shaped, and located such that it is operable to provide thermal communication between the voice coil and the heatsink.

8. The loudspeaker assembly of claim 1, further comprising a heatsink coupled to the outer surface of the bobbin and being in thermal communication with the voice coil.

9. The apparatus of claim 8, wherein the heatsink includes an envelope defining an inner wall and an outer wall, the inner wall being operatively coupled to the outer surface of the bobbin and being in thermal communication with the voice coil.

10. The apparatus of claim 9, wherein the bobbin includes a forward axial end and a rearward axial end, the heatsink being disposed toward the forward axial end, and the voice coil being disposed toward the rearward axial end.

11. The apparatus of claim 10, further comprising: a thermally conductive member being coupled to the outer surface of the bobbin and being in thermal communication with the voice coil and the heatsink.

12. The apparatus of claim 11, wherein:

the thermally conductive member includes an inner surface and an outer surface;

the inner surface of the thermally conductive member is coupled to the outer surface of the bobbin; and the inner wall of the heatsink is coupled to the outer surface of the thermally conductive member.

13. The apparatus of claim 12, wherein:

the voice coil defines an inner wall and an outer wall, the inner wall of the voice coil being coupled to the outer surface of the bobbin; and the inner surface of the thermally conductive member is in thermal communication with outer wall of the voice coil.

14. The apparatus of claim 12, wherein the voice coil defines an inner wall and an outer wall, the inner wall of the voice coil being coupled to the outer surface of the thermally conductive member.

15. The apparatus of claim 9, wherein:

the apparatus further comprises a diaphragm having a forward surface, a rearward surface, and an inner peripheral edge that is coupled to the outer surface of the bobbin, the diaphragm extending obliquely away from the outer surface of the bobbin such that the forward surface defines an acute angle with respect to the outer surface of the bobbin and the diaphragm forms a cone shape; and the outer wall of the heatsink includes a beveled portion that is operatively coupled to the forward surface of the diaphragm.

16. The apparatus of claim 9, wherein at least one of:

the envelope of the heatsink is defined by a plurality of fins extending radially outward from the inner wall of the heatsink;

the plurality of fins are formed by one or more corrugated surfaces;

the plurality of fins are formed by one or more separated fin elements; and the fin elements are hollow.

17. The apparatus of claim 1, wherein the wall member of the bobbin is cylindrical or oval.

18. An apparatus, comprising:

a bobbin having a wall member including an outer surface operable to support a voice coil of a loudspeaker and an inner surface defining an inner volume;

a diaphragm having an inner peripheral edge, an outer peripheral edge, a forward surface, and a rearward surface, the inner peripheral edge being operatively coupled to the bobbin;

a heatsink coupled to the bobbin, being in thermal communication with the voice coil, including a plurality of fins extending radially away from the bobbin, and the fins thereof being operatively coupled to the forward surface of the diaphragm.

19. The apparatus of claim 18, wherein:

the diaphragm extends obliquely away from the outer surface of the bobbin to form a cone shape, and the forward surface of the diaphragm defines an acute angle with respect to the outer surface of the bobbin; and the fins of the heats ink each include a first edge extending along the outer surface of the bobbin and a second edge operatively coupled to the diaphragm thereby increasing a strength of the diaphragm, and the second edge of each fin defines a corresponding acute angle with respect to the first edge of the fin such that a substantial portion of the second edge of the fin is operable to couple to the forward surface of the diaphragm.

20. The apparatus of claim 18, wherein the wall member of the bobbin is cylindrical or oval.

21. The apparatus of claim 18, wherein the heatsink includes a substantially cylindrical envelope defining an inner wall and an outer wall, the inner wall being operatively coupled to the outer surface of the bobbin and being in thermal communication with the voice coil.

22. The apparatus of claim 21, wherein the bobbin includes a forward axial end and a rearward axial end, the heatsink being disposed toward the forward axial end, and the voice coil being disposed toward the rearward axial end.

23. The apparatus of claim 22, further comprising: a thermally conductive member being coupled to the outer surface of the bobbin and being in thermal communication with the voice coil and the heatsink.

24. The apparatus of claim 23, wherein:

the thermally conductive member includes an inner surface and an outer surface;

the inner surface of the thermally conductive member is coupled to the outer surface of the bobbin; and the inner wall of the heatsink is coupled to the outer surface of the thermally conductive member.

25. The apparatus of claim 24, wherein:

the voice coil defines an inner wall and an outer wall, the inner wall of the voice coil being coupled to the outer surface of the bobbin; and the inner surface of the thermally conductive member is in thermal communication with outer wall of the voice coil.

26. The apparatus of claim 24, wherein the voice coil defines an inner wall and an outer wall, the inner wall of the voice coil being coupled to the outer surface of the thermally conductive member.

27. The apparatus of claim 21, wherein at least one of:

the substantially cylindrical envelope of the heatsink is defined by a plurality of fins extending radially outward from the inner wall of the heatsink;

the plurality of fins are formed by one or more corrugated surfaces;

the plurality of fins are formed by one or more separated fin elements; and the fin elements are hollow.

28. The apparatus of claim 18, further comprising: a second heatsink coupled to the inner surface of the substantially cylindrical shaped wall member of the bobbin and being in thermal communication with the voice coil, wherein the second heatsink includes a plurality of fins extending axially along and radially inward from the inner surface of the bobbin such that axial movement of the bobbin forces air within the inner volume of the bobbin to carry heat away from the second heatsink.

29. The apparatus of claim 18, further comprising:

a pole disposed at least partially within the inner volume of the voice coil that is operable to direct a magnetic flux therethrough, the pole including an aperture extending therethrough that is in axial alignment with the bobbin and the voice coil; and a second heatsink coupled to an inner surface of the aperture of the pole, wherein the second heatsink includes a plurality of fins extending axially along and radially inward from the inner surface of the aperture such that axial movement of the bobbin forces air to carry heat away from the second heatsink.

30. The apparatus of claim 18, further comprising:

a pole disposed at least partially within the inner volume of the voice coil that is operable to direct a magnetic flux therethrough;

a top plate having a disc shape, an upper surface, and an aperture therethrough, which is in coaxial alignment with the voice coil and an upper portion of the pole, the top plate being operable to direct the magnetic flux through the voice coil; and a second heatsink having a disc shape, a lower surface, and an aperture, the lower surface of the second heatsink being coupled to the upper surface of the top plate such that the aperture of the second heatsink is axially aligned with the aperture of the top plate, wherein the second heatsink includes a plurality of fins extending radially outward from the aperture such that they are in thermal communication with the voice coil, and such that axial movement of the bobbin forces air to carry heat away from the second heatsink.

31. An apparatus, comprising:

a bobbin having a wall member including an outer surface operable to support a voice coil of a loudspeaker and an inner surface defining an inner volume; and a heatsink coupled to the inner surface of the substantially cylindrical shaped wall member of the bobbin and being in thermal communication with the voice coil, wherein the heatsink includes a plurality of fins extending axially along and radially inward from the inner surface of the bobbin such that axial movement of the bobbin forces fluids within the inner volume of the bobbin to carry heat away from the heatsink.

32. The apparatus of claim 31, wherein the wall member of the bobbin is cylindrical or oval.

33. The apparatus of claim 31, wherein at least one of: the plurality of fins are formed by one or more corrugated surfaces; the plurality of fins are formed by one or more separated fin elements; and the fin elements are hollow.

34. The apparatus of claim 31, wherein the plurality of fins are operable to provide mechanical strength to the bobbin.

35. An apparatus, comprising:

a bobbin having a substantially cylindrical shaped wall member including an outer surface operable to support a voice coil of a loudspeaker and an inner surface defining an inner volume;

a pole disposed at least partially within the inner volume of the voice coil that is operable to direct a magnetic flux therethrough, the pole including an aperture extending therethrough that is in axial alignment with the bobbin and the voice coil; and a heatsink coupled to an inner surface of the aperture of the pole, wherein the heatsink includes a plurality of fins extending axially along and radially inward from the inner surface of the aperture such that axial movement of the bobbin forces air to carry heat away from the heatsink.

36. A method, comprising:

providing thermal communication and electro-magnetic communication between a inner part of a voice coil of a loudspeaker and a magnetic pole within an inner volume of a bobbin by way of at least one aperture through a wall member of the bobbin that is operable to support the voice coil, the at least one aperture being completely covered by the voice coil to: (i) provide thermal communication from the voice coil through the wall member to the magnetic pole; and (ii) inhibit air flow through the at least one aperture.

37. The method of claim 36, further comprising:

disposing a magnetic pole at least partially within the inner volume of the voice coil such that it can direct a magnetic flux therethrough; and permitting thermal communication between the inner part of a voice coil and the magnetic pole by way of the at least one aperture.

38. The method of claim 36, further comprising providing thermal communication between the voice coil of the loudspeaker and a heatsink, the heatsink being coupled to the outer surface of the bobbin and being in thermal communication with the voice coil.

39. The method of claim 38, further comprising increasing a strength of a diaphragm of the loudspeaker by coupling the heatsink to the diaphragm.

* * * * *